US010913081B2

(12) United States Patent
Chang

(10) Patent No.: US 10,913,081 B2
(45) Date of Patent: Feb. 9, 2021

(54) SPRAY QUANTITY ADJUSTABLE FOAM/LIQUID DUAL-PURPOSE DISTRIBUTION DEVICE

(71) Applicant: Guangzhou Faner Aroma Product Co., Ltd., Guangzhou (CN)

(72) Inventor: Hsu-Hui Chang, Guangzhou (CN)

(73) Assignee: GUANGZHOU FANER AROMA PRODUCT CO., LTD., Guangzhou (CN)

( * ) Notice: Subject to any disclaimer, the term of this patent is extended or adjusted under 35 U.S.C. 154(b) by 105 days.

(21) Appl. No.: 16/290,979

(22) Filed: Mar. 4, 2019

(65) Prior Publication Data

US 2019/0193096 A1 Jun. 27, 2019

Related U.S. Application Data

(63) Continuation-in-part of application No. 15/294,801, filed on Oct. 17, 2016, now abandoned.

(51) Int. Cl.

| | |
|---|---|
| ***B05B 7/24*** | (2006.01) |
| ***B05B 7/00*** | (2006.01) |
| ***B05B 1/30*** | (2006.01) |

(52) U.S. Cl.

CPC ..... *B05B 7/0025* (2013.01); *B05B 1/30* (2013.01); *B05B 7/2427* (2013.01)

(58) Field of Classification Search

CPC ..... B05B 7/0025; B05B 7/2427
USPC ..... 239/311
See application file for complete search history.

(56) References Cited

U.S. PATENT DOCUMENTS

| | | | | |
|---|---|---|---|---|
| 3,811,660 A * | 5/1974 | Cole, Jr. | ..... | E21F 5/06 261/18.1 |
| 2015/0040848 A1* | 2/2015 | McAlister | ..... | F02B 17/00 123/1 A |

* cited by examiner

*Primary Examiner* — Chee-Chong Lee
(74) *Attorney, Agent, or Firm* — Leong C. Lei

(57) ABSTRACT

A spray quantity adjustable foam/liquid dual-purpose distribution device includes a gas compressor, an isolation electromagnetic valve, a liquid accumulator, an electromagnetic valve, and a foam generation device that are connected to each other. The gas compressor supplies pressurized gas into the isolation electromagnetic valve and/or the liquid accumulator or the foam generation device. When the pressurized gas is supplied into the liquid accumulator, an internal pressure of the liquid accumulator is increased to force liquid contained in the liquid accumulator toward the electromagnetic valve, which, once activated, conduct the liquid to the foam generation device, so that the pressurized gas and the liquid are mixed in the foam generation device to generate a foamed liquid that is discharged out through an egress opening.

8 Claims, 4 Drawing Sheets

SPRAY QUANTITY ADJUSTABLE FOAM/LIQUID DUAL-PURPOSE DISTRIBUTION DEVICE

CROSS-REFERENCE TO RELATED APPLICATION

This is a continuation-in-part of co-pending U.S. patent application Ser. No. 15/294,801 filed on Oct. 17, 2016.

(a) TECHNICAL FIELD OF THE INVENTION

The present invention relates generally to a foam/liquid dual-purpose distribution device, which is applicable to general food and beverage service, cleaning and hygiene, and disinfection and sterilization.

(b) DESCRIPTION OF THE PRIOR ART

To build up a large quantity of bubbles in liquid, a common way is to mix gas and liquid to generate foamed liquid that includes therein bubbles or foams. Making of the foamed liquid often needs gas that is supplied from a gas supply device and liquid that is drawn in with a liquid pump to be supplied to a foaming apparatus in order to have the gas and the liquid mixed with each other and then, a foamed liquid having a predetermined mixture ratio between the gas and the liquid can be formed.

However, the operations of the gas supply device and the liquid pump do not allow for effective control of the ratio between the gas and the liquid so supplied or pumped. In addition, in case that the liquid pump is in operation while the gas pump is shut down, the liquid would undesirably flow into the gas supply device and this could damage or break down the gas supply device. This makes it generally not possible to supply the liquid alone. Thus, for the purposes of overcoming the above-discussed drawbacks of being impossible to effectively control the ration between the gas and the liquid and being impossible to output liquid alone and also for saving the cost of the liquid pump, the present invention aims to provide a spray quantity adjustable foam/liquid dual-purpose distribution device, which allows for effective regulation of an output quantity of pressurized gas or liquid, saving of manufacturing cost, and discharge of foam formed of any desired mixture ratio of gas and liquid and having an adjustable spray quantity or discharge of liquid alone, in order to overcome the drawbacks of the prior art and improve the utilization and performance.

SUMMARY OF THE INVENTION

To achieve the above objective, the present invention provides a spray quantity adjustable foam/liquid dual-purpose distribution device, which comprises:

a gas compressor, which is provided, at predetermined locations, with a gas inlet and a gas outlet;

a first three-way fitting, which comprises a first tube, a second tube, and a third tube that are in communication with each other, the first tube being connected to the gas outlet, the second tube being connected to a one-way valve;

an isolation electromagnetic valve, which is provided, in an interior thereof, with a first inlet channel and a first outlet channel, the first inlet channel being connected to the third tube so that pressurized gas may be supplied from the gas compressor to the isolation electromagnetic valve, the isolation electromagnetic valve being operable to control connection to or disconnection between the first inlet channel and the first outlet channel;

a liquid accumulator, which has an end in which a gas introduction opening and a liquid discharge opening are formed, the liquid discharge opening being provided with a liquid guide device, wherein the liquid guide device has an end extending into the liquid accumulator to a location close to a bottom of the liquid accumulator, the liquid guide device having an opposite end extending through the liquid discharge opening to reach outside of the liquid accumulator;

a second three-way fitting, which comprises a fourth tube, a fifth tube, and a sixth tube, the gas introduction opening being connected to the fourth tube, the fifth tube being connected to the one-way valve;

an isolation release valve, which comprises a second inlet channel and a second output channel, the second input channel being connected to the sixth tube;

an electromagnetic valve, which is connected to the opposite end of the liquid guide device to conduct liquid into the electromagnetic valve, the electromagnetic valve being provided, in an interior thereof, with a liquid discharge channel, the electromagnetic valve being operable to selectively control the liquid discharge channel to open or close; and a foam generation device, which is connected to the first outlet channel and the liquid discharge channel, the foam generation device having an end in which an egress opening is formed.

In the above-described liquid accumulator, the liquid accumulator comprises an interior space that is an enclosed space formed in an interior of the liquid accumulator to receive and contain therein the liquid.

In the above-described foaming generation device, the foam generation device comprises a foaming chamber formed in an interior thereof, so that when the first outlet channel supplies the pressurized gas into the foam generation device and the liquid discharge channel supplies the liquid into the foam generation device, the pressurized gas and the liquid are mixed with each other in the foaming chamber to form a foamed liquid and the foamed liquid is discharged out through the egress opening.

In the above-described liquid guide device, the liquid guide device comprises a sieve mounted to an end thereof to prevent impurities contained in the liquid from blocking or jamming the electromagnetic valve or the foam generation device.

In the above-described gas compressor, the gas compressor, the isolation electromagnetic valve, and the electromagnetic valve are electrically connected to a circuit board.

In the above-described gas compressor, the gas inlet and the gas outlet are provided at the predetermined locations on an end or a side of the gas compressor.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
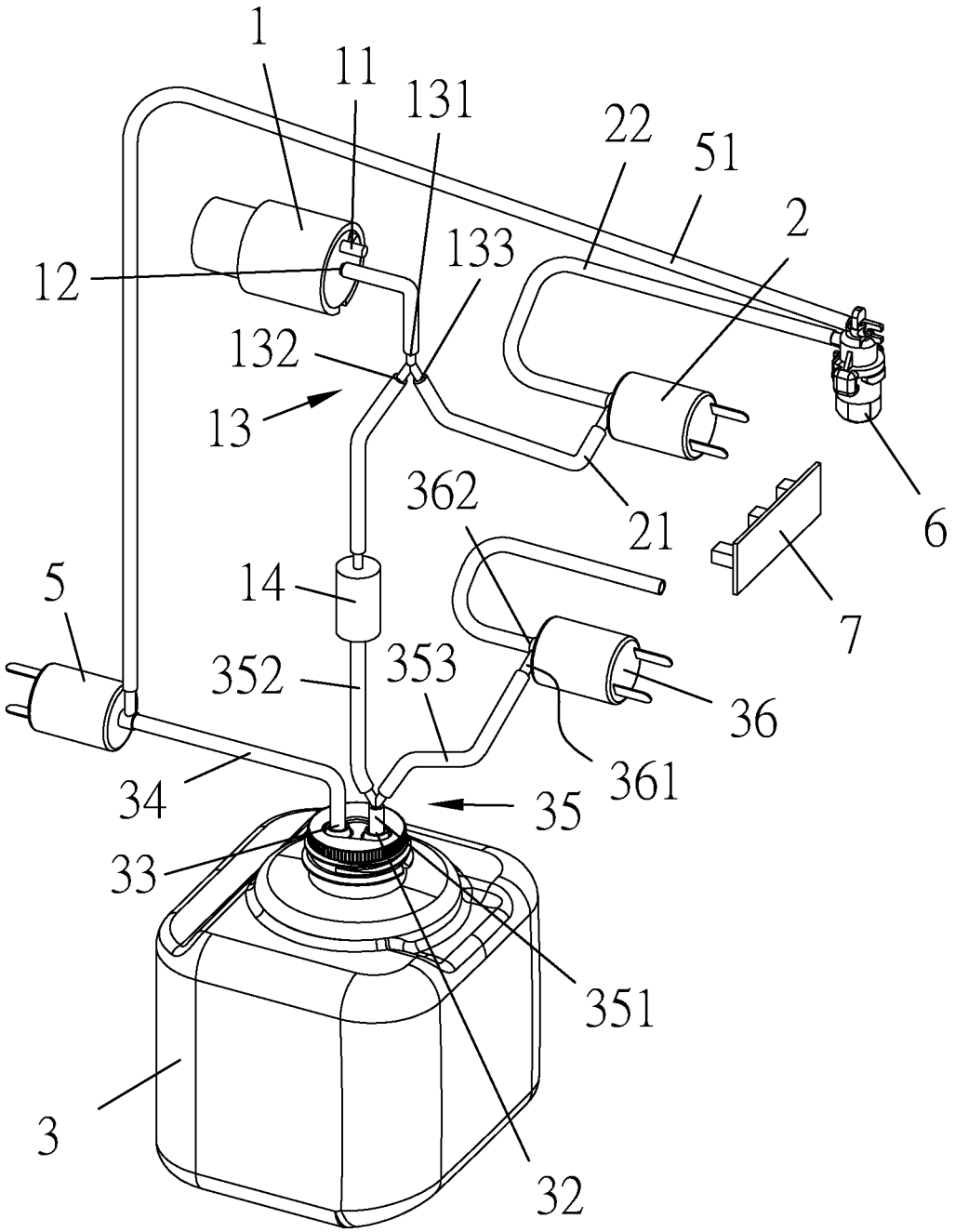
FIG. 1 is a perspective view showing the present invention.

Referring to FIG. 1, which is a perspective view of the present invention, as shown in the drawing, the present invention generally comprises a gas compressor 1, and the gas compressor 1 comprises a gas inlet 11 and a gas outlet 12 formed at predetermined locations of an end or a side thereof.

A first three-way fitting 13 comprises a first tube 131, a second tube 132, and a tube 133 that are in communication with each other. The first tube 131 is connected to the gas outlet 12 so that the gas compressor 1 supplies pressurized gas into the first control valve 2. The second tube 132 is connected to a one-way valve 14.

An isolation electromagnetic valve 2 is provided, in an interior thereof, with a first inlet channel 21 and a first outlet channel 22. The first inlet channel 21 is connected to the third tube 133 so that pressurized gas may be supplied from the gas compressor 1 to the isolation electromagnetic valve 2. The isolation electromagnetic valve 2 controls connection to or disconnection between the first inlet channel 21 and the first outlet channel 22.

A liquid accumulator 3 is provided. The liquid accumulator 3 comprises an interior space that is an enclosed space in which liquid 31 is received and contained. The liquid accumulator 3 is provided, in one end thereof, with a gas introduction opening 32 and a liquid discharge opening 33. The liquid discharge opening 33 is provided with and coupled to a liquid guide device 34. The liquid guide device 34 has an end extending deeply into the liquid accumulator 3 to a location close to a bottom of the liquid accumulator 3. The liquid guide device 34 also has an opposite end extending through the liquid discharge opening 33 to reach to the outside of the liquid accumulator 3. The liquid guide device 34 is provided, at an end thereof, with a sieve 4 mounted thereto to prevent impurities or contaminants contained in the liquid from blocking and jamming an electromagnetic valve 5 or a foam generation device 6, which will be described later.

A second three-way fitting 35 is provided. The second three-way fitting 35 comprises a fourth tube 351, a fifth tube 352, and a sixth tube 353. The gas introduction opening 32 is connected to the fourth tube 351. The fifth tube 352 is connected to the one-way valve 14.

An isolation release valve 36 comprises a second inlet channel 361 and a second output channel 362. The second input channel 361 is connected to the sixth tube 353.

The electromagnetic valve 5 is arranged such that the electromagnetic valve 5 is connected to said opposite end of the liquid guide device 34 to allow the liquid 31 to be fed to the electromagnetic valve 5. The electromagnetic valve 5 is provided, in an interior thereof, with a liquid discharge channel 51. The electromagnetic valve 5 controls the liquid discharge channel 51 for selectively opening or closing the channel.

The foam generation device 6 is arranged such that the foam generation device 6 is connected to the first outlet channel 22 and the liquid discharge channel 51. The foam generation device 6 comprises an egress opening 61 formed in one end thereof. The foam generation device 6 comprises a foaming chamber 62 formed in an interior thereof such that when the first outlet channel 22 supplies the pressurized gas into the interior of the foam generation device and the liquid discharge channel 51 supplies the liquid 31 into the interior of the foam generation device 6, the pressurized gas and the liquid 31 are received into and mixed in the foaming chamber 62 to form a foamed liquid and the foamed liquid is subsequently discharged through the egress opening.

In the above-described gas compressor 1, the gas compressor 1, the isolation electromagnetic valve 2, and the electromagnetic valve 5 are electrically connected to a circuit board 7.

Figure 2:
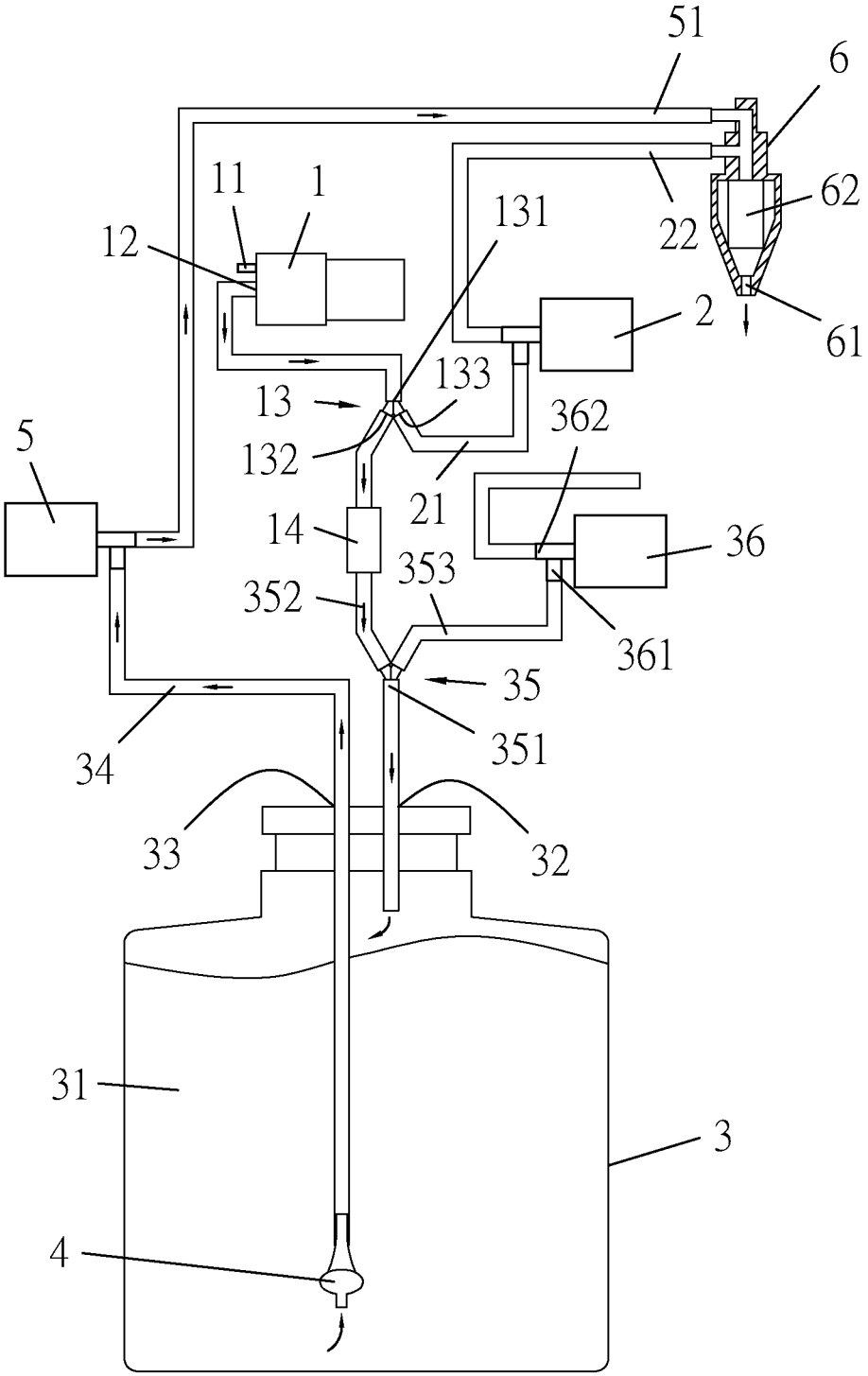
FIG. 2 is a schematic view of the present invention, illustrating discharging of liquid.

Referring to FIG. 2, the gas compressor 1 receives and conducts external gas through the gas inlet 11 into the gas compressor 1 to have the gas compressed and generating pressurized gas. Then, the gas outlet 12 feeds out the pressurized gas. The pressurized gas passes through the one-way valve 14 to get into the liquid accumulator 3 to increase an internal pressure of the liquid accumulator 3. The electromagnetic valve 5, after being activated or opening, enables, by means of the pressure, the liquid 31 of the liquid accumulator 3 to flow through the liquid discharge channel 51 to the egress opening 61 of the foam generation device 6.

Figure 3:
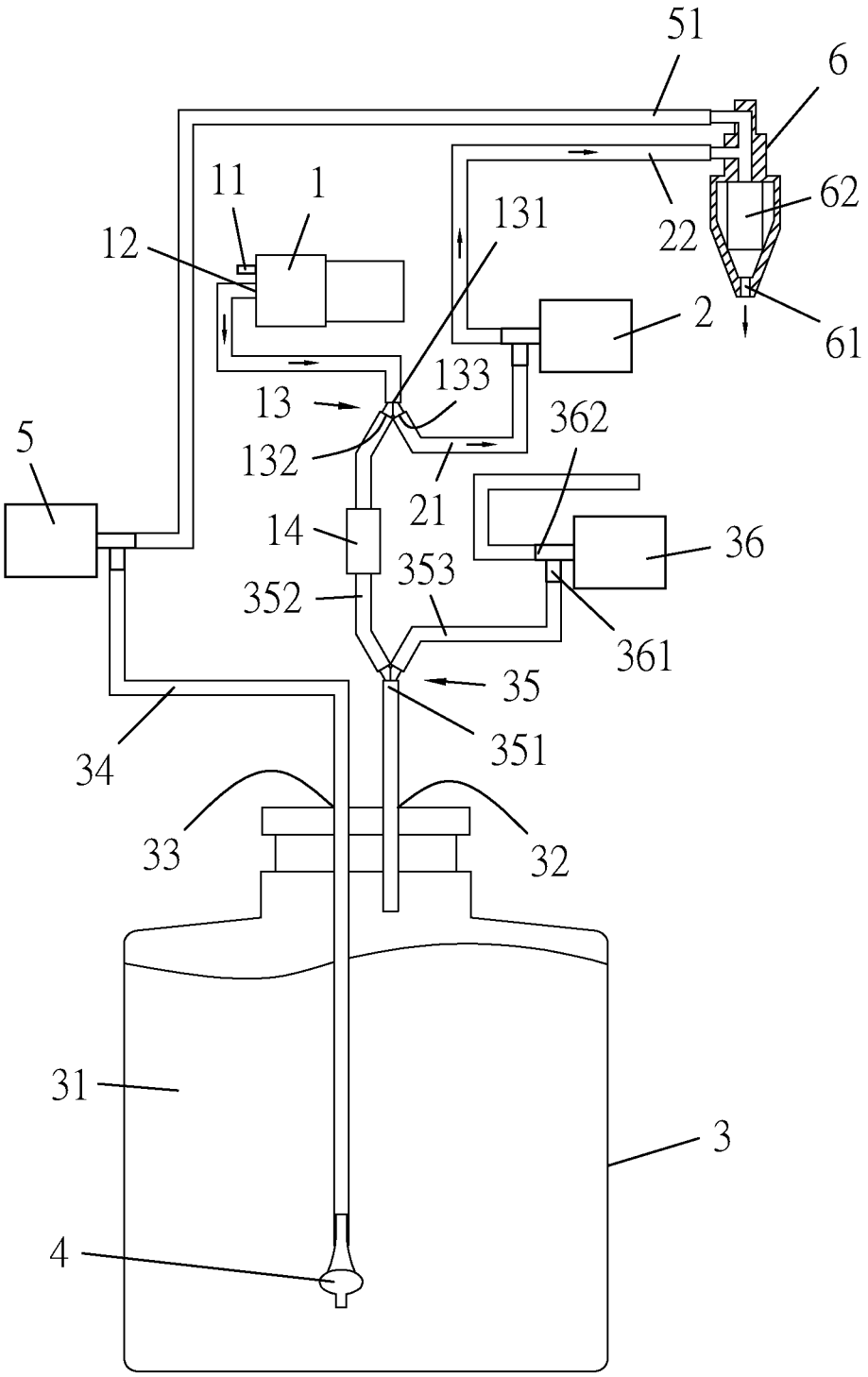
FIG. 3 is a schematic view of the present invention, illustrating discharging of pressurized gas.

Referring to FIGS. 2 and 3, to generate foam, the gas compressor 1 and the isolation electromagnetic valve 2 are activated to supply pressurized gas through the first outlet channel 22 into the foaming chamber 62 of the foam generation device 6 to have the pressurized gas mixed with the liquid 31 to generate foam.

Figure 4:
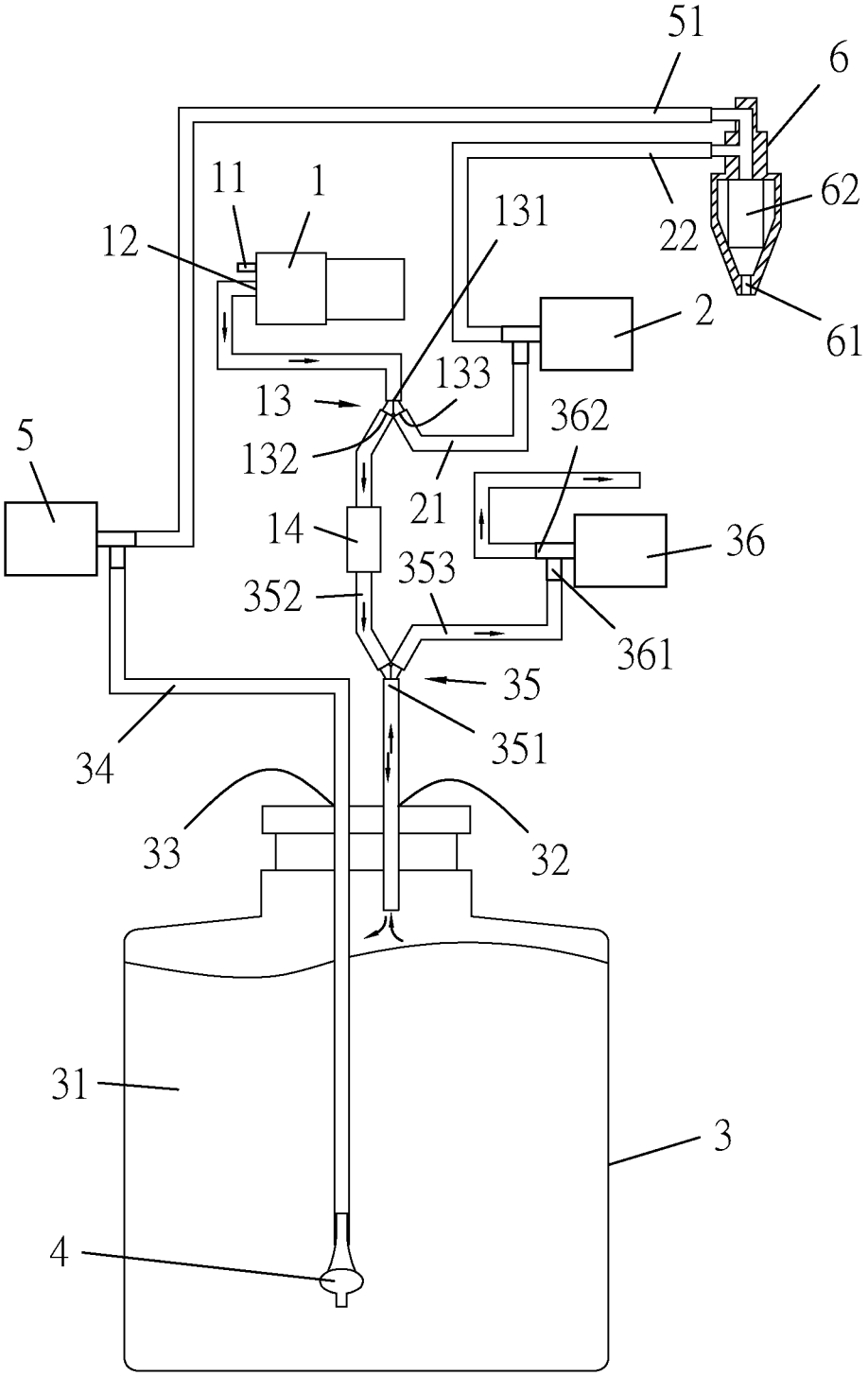
FIG. 4 is a schematic view illustrating pressurized gas entering a liquid accumulator and releasing of gas.

Referring to FIG. 4, after an operation of discharging or dispensing gas/liquid or a mixture thereof, in a quantitative manner, the isolation electromagnetic valve 2, the isolation release valve 36, and electromagnetic valve 5 are turned off or closed, while the gas compressor 1 is kept on to make the internal pressure of the liquid accumulator 3 reach a predetermined level of gas pressure. Such an operation of supplementing or replenishing gas is carried out for a period of time that is around one quarter of an operation of discharging or dispensing the gas and liquid or a mixture thereof, so as to similarly achieve the function of mixture of gas and liquid in a desired ratio.

In other words, when foam is not desired, the isolation electromagnetic valve 2 is deactivated, and only the gas compressor 1 is set on to keep a substantial ejection amount of gas. Alternatively, the gas compressor 1 is set off and the pressure inside the liquid accumulator 3 that is achieved through supplementing of gas in advance would drive the liquid 31 out so as to achieve ejection and discharge of the liquid 31.

To replace the liquid accumulator 3, before the liquid accumulator 3 is opened, the isolation release valve 36 is activated to release gas from the liquid accumulator 3 in order to ensure safety of opening the liquid accumulator 3.

The one-way valve 14 functions to isolate the gas inside the liquid accumulator 3 during an operation of discharging gas in order to prevent the gas contained in the liquid accumulator 3 from undesirably released to the outside. Due the internal pressure of the liquid accumulator 3 that might be increased to a certain high level, when the electromagnetic valve 5 is activated or open, the liquid 31 is allowed to flow out, and as such, a function of controlling of discharging or dispensing of both foam and liquid 31 can be realized.

As such, effectively controlling the output quantity of the pressurized gas or the liquid 31 can be achieved by controlling the opening and closing of the isolation electromagnetic valve 2, the electromagnetic valve 5, and the isolation release valve 36, so that effects of saving manufacturing costs and continuously generating foam at any desired mixture ratio can be achieved.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A spray quantity adjustable foam/liquid dual-purpose distribution device, comprising:

a gas compressor, which is provided, at predetermined locations, with a gas inlet and a gas outlet;

a first three-way fitting, which comprises a first tube, a second tube, and a third tube that are in communication with each other, the first tube being connected to the gas outlet, the second tube being connected to a one-way valve;

an isolation electromagnetic valve, which is provided with a first inlet channel and a first outlet channel, the first inlet channel being connected to the third tube so that pressurized gas may be supplied from the gas compressor to the isolation electromagnetic valve, the isolation electromagnetic valve being operable to control connection to or disconnection between the first inlet channel and the first outlet channel;

a liquid accumulator, which has an end in which a gas introduction opening and a liquid discharge opening are formed, the liquid discharge opening being provided with a liquid guide device, wherein the liquid guide device has an end extending into the liquid accumulator to a location close to a bottom of the liquid accumulator, the liquid guide device having an opposite end extending through the liquid discharge opening to reach outside of the liquid accumulator;

a second three-way fitting, which comprises a fourth tube, a fifth tube, and a sixth tube, the gas introduction opening being connected to the fourth tube, the fifth tube being connected to the one-way valve;

an isolation release valve, which comprises a second inlet channel and a second output channel, the second input channel being connected to the sixth tube;

an electromagnetic valve, which is connected to the opposite end of the liquid guide device to conduct liquid into the electromagnetic valve, the electromagnetic valve being provided, in an interior thereof, with a liquid discharge channel, the electromagnetic valve being operable to selectively control the liquid discharge channel to open or close; and a foam generation device, which is connected to the first outlet channel and the liquid discharge channel, the foam generation device having an end in which an egress opening is formed;

wherein in a first operation mode of multiple operation modes, gas is supplied from the gas compressor along a first gas passage through the first three-way fitting and the isolation electromagnetic valve to the foam generation device and liquid is supplied from the liquid accumulator along a liquid passage through the electromagnetic valve to the foam generation device, wherein the first gas passage and the liquid passage are separate from each other, such that the gas and the liquid are separately, individually, and directly supplied from the gas compressor and the liquid accumulator to the foam generation device; and wherein in a second operation mode of the multiple operation modes, the gas is supplied from the gas compressor along a second gas passage by sequentially flowing through the first three-way fitting, the one-way valve, and the second three-way fitting to the liquid accumulator, wherein the one-way valve is connected between the first three-way fitting and the second three-way fitting to block a reversed flow of the gas from the liquid accumulator to the first three-way fitting and to maintain a predetermined internal pressure of the liquid accumulator by which liquid is forced through the liquid passage to directly flow to the foam generation device.

2. The spray quantity adjustable foam/liquid dual-purpose distribution device according to claim 1, wherein the liquid accumulator comprises an interior space that is an enclosed space formed in an interior of the liquid accumulator to receive and contain therein the liquid.

3. The spray quantity adjustable foam/liquid dual-purpose distribution device according to claim 1, wherein the foam generation device comprises a foaming chamber formed in an interior thereof, so that when the first outlet channel supplies the pressurized gas into the foam generation device and the liquid discharge channel supplies the liquid into the foam generation device, the pressurized gas and the liquid are mixed with each other in the foaming chamber to form a foamed liquid and the foamed liquid is discharged out through the egress opening.

4. The spray quantity adjustable foam/liquid dual-purpose distribution device according to claim 1, wherein the liquid guide device has an outer circumferential that is set in airtight engagement with the liquid discharge opening.

5. The spray quantity adjustable foam/liquid dual-purpose distribution device according to claim 4, wherein the liquid guide device comprises a sieve mounted to an end thereof to prevent impurities contained in the liquid from blocking or jamming the electromagnetic valve or the foam generation device.

6. The spray quantity adjustable foam/liquid dual-purpose distribution device according to claim 1, wherein the gas compressor, the isolation electromagnetic valve, and the electromagnetic valve are electrically connected to a circuit board.

7. The spray quantity adjustable foam/liquid dual-purpose distribution device according to claim 1, wherein the gas inlet and the gas outlet are provided at the predetermined locations on an end or a side of the gas compressor.

8. The spray quantity adjustable foam/liquid dual-purpose distribution device according to claim 1, wherein the isolation electromagnetic valve and the electromagnetic valve are closable simultaneously so as to keep the interior of the liquid accumulator at a predetermined pressure to allow the liquid to be immediately fed out in a next operation of activating the isolation electromagnetic valve and the electromagnetic valve to immediately discharge the liquid with effective control of an output quantity of the liquid.

* * * * *